US007120952B1

(12) United States Patent
Bass et al.

(10) Patent No.: US 7,120,952 B1
(45) Date of Patent: Oct. 17, 2006

(54) INCONTINENCE PROTECTIVE DEVICE

(76) Inventors: Beverly Bass, 4836 Aukai Ave., Honolulu, HI (US) 96816; Kathleen Organ, 6226 Kawaihae Pl. #115, Honolulu, HI (US) 96825

( * ) Notice: Subject to any disclaimer, the term of this patent is extended or adjusted under 35 U.S.C. 154(b) by 306 days.

(21) Appl. No.: 10/762,057

(22) Filed: Jan. 20, 2004

(51) Int. Cl.
*A47G 9/00* (2006.01)

(52) U.S. Cl. ..... 5/484; 5/497; 5/499; 5/500

(58) Field of Classification Search ..... 5/484, 5/487, 497, 499, 500, 502
See application file for complete search history.

(56) References Cited

U.S. PATENT DOCUMENTS

| | | | | | |
|---|---|---|---|---|---|
| 596,842 | A | | 1/1898 | Borwell | 428/221 |
| 1,621,149 | A | * | 3/1927 | Blissit | 5/500 |
| 1,722,429 | A | | 7/1929 | Kaufman | 5/499 |
| 1,928,943 | A | * | 10/1933 | McKay | 5/484 |
| 2,319,150 | A | * | 5/1943 | Mink | 5/499 |
| 2,414,927 | A | * | 1/1947 | Chapman | 5/484 |
| 2,516,363 | A | * | 7/1950 | Block et al. | 5/500 |
| 2,585,861 | A | | 2/1952 | Small et al. | 5/484 |
| 3,066,321 | A | | 12/1962 | Kintner | 5/498 |
| 3,113,326 | A | | 12/1963 | Hyde et al. | 5/484 |
| 3,591,875 | A | * | 7/1971 | Zipf et al. | 5/487 |
| 3,761,973 | A | * | 10/1973 | Leventhal | 5/484 |
| 3,989,867 | A | | 11/1976 | Sisson | 428/132 |
| 4,021,870 | A | * | 5/1977 | Walters | 5/484 |
| 4,064,577 | A | * | 12/1977 | Walters | 5/484 |
| 4,097,943 | A | | 7/1978 | O'Connell | 5/484 |
| 4,391,010 | A | * | 7/1983 | Kronman | 5/484 |
| 4,499,131 | A | * | 2/1985 | Knox | 428/68 |
| 4,524,474 | A | | 6/1985 | Svensson | 5/484 |
| 4,627,122 | A | * | 12/1986 | Hopp | 5/484 |
| 4,627,426 | A | * | 12/1986 | Wegener et al. | 604/356 |
| 4,704,753 | A | * | 11/1987 | Lunt | 5/484 |
| 4,777,677 | A | * | 10/1988 | Dugan | 5/13 |
| 4,899,408 | A | * | 2/1990 | Illingworth | 5/484 |
| 5,081,729 | A | * | 1/1992 | Menday | 5/487 |
| 5,125,121 | A | * | 6/1992 | Wroble | 5/484 |
| 5,221,273 | A | * | 6/1993 | Graham | 604/358 |
| 5,249,320 | A | | 10/1993 | Moretz et al. | 5/484 |
| 5,388,296 | A | | 2/1995 | Mansour | 5/636 |
| 5,701,617 | A | | 12/1997 | Colby | 5/484 |
| 5,787,523 | A | | 8/1998 | Lindberg | 5/81.1 HS |
| 6,233,762 | B1 | * | 5/2001 | Bradley | 5/484 |
| 6,381,778 | B1 | * | 5/2002 | Peterson | 5/497 |
| 6,859,962 | B1 | * | 3/2005 | Diak-Ghanem | 5/499 |
| 2003/0177579 | A1 | * | 9/2003 | Diak-Ghanem | 5/499 |

FOREIGN PATENT DOCUMENTS

| | | |
|---|---|---|
| GB | 2.189.993 | 11/1987 |
| GB | 2.315.224 | 1/1998 |

* cited by examiner

*Primary Examiner*—Robert G. Santos
(74) *Attorney, Agent, or Firm*—Michael I. Kroll

(57) ABSTRACT

Disclosed is a disposable fitted protective device that may be manufactured of antibacterial, ant-microbiodical and hypoallergenic material for bedding and furniture comprising an impermeable layer bonded to an absorbent fibrous layer. Each of the sides is folded to form spaced apart walls with the sides fastened together, such as sown or bonded, at the corners with the impermeable material positioned on the interior side. The washable incontinence device for bedding, furniture cushions and pillow covers is comprised of cotton or cotton poly blend surface with an absorbent layer of poly rayon or poly with a waterproof vinyl or elastic type material sewn, bonded or laminated barrier back that is machine washable and reusable with elastic for fit.

12 Claims, 12 Drawing Sheets

INCONTINENCE PROTECTIVE DEVICE

BACKGROUND OF THE INVENTION

1. Field of the Invention

The present invention relates generally to protective devices and, more specifically, to a disposable fitted protective device that may be manufactured of antibacterial, anti-microbiodical and hypoallergenic material for bedding and furniture comprising an impermeable layer bonded to an absorbent fibrous layer. Each of the sides is folded to form spaced apart walls with the adjacent sides fastened together, such as sown or bonded, at the corners with the impermeable material positioned on the interior side. Along the peripheral edge of the corners an elastic strap is fastened, such as sown or bonded, whereby the aperture formed thereby is smaller than the material surface area between the spaced apart walls. Therefore, when the fitted protective element is placed to encompass an article's sides and top surface, the elastic tensions the material on the underside of the article to prevent displacement from the selected positioning. The disposable element may be degradable and/or biodegradable.

Additionally, the invention provides for an additional element wherein said incontinence device is a washable product that will be constructed to fit mattresses, seat cushions, and pillows. The washable/reusable incontinence device for bedding, furniture cushions and pillow covers is comprised of cotton or cotton poly blend surface with an absorbent layer of poly rayon or poly with a waterproof vinyl or elastic type material sewn, bonded or laminated forming a barrier back, with elastic for fitment.

Furthermore, the present invention provides for a machine washable incontinence device, thereby reusable, for bedding, furniture cushions and pillow covers comprised of a fabric surface that may be manufactured of antibacterial, anti-microbiodical and hypoallergenic material with an inner absorbent layer and an integral waterproof barrier back having elastic positioned along the hem for fitment.

2. Description of the Prior Art

There are other protective device designed for bedding. Typical of these is U.S. Pat. No. 596,842 issued to Borwell on Jan. 4, 1898.

Another patent was issued to Kaufmann on Jul. 30, 1929 as U.S. Pat. No. 1,722,429. Yet another U.S. Pat. No. 2,585,861 was issued to Small et al. on Feb. 12, 1952 and still yet another was issued on Dec. 4, 1962 to Kintner as U.S. Pat. No. 3,066,321.

Another patent was issued to Hyde et al. on Dec. 10, 1963 as U.S. Pat. No. 3,113,326. Yet another U.S. Pat. No. 3,989,867 was issued to Sisson on Nov. 2, 1976. Another was issued to O'Connell on Jul. 4, 1978 as U.S. Pat. No. 4,097,943 and still yet another was issued on Jun. 25, 1985 to Svensson as U.S. Pat. No. 4,524,474.

Another patent was issued to Moretz et al. on Oct. 5, 1993 as U.S. Pat. No. 5,249,320. Yet another U.S. Pat. No. 5,388,296 was issued to Mansour on Feb. 14, 1995. Another was issued to Colby on Dec. 30, 1997 as U.S. Pat. No. 5,701,617. Yet another U.S. Pat. No. 5,787,523 was issued to Lindberg on Aug. 4, 1998. Another was issued to Dilloway on Nov. 11, 1987 as UK Patent No. 2 189 993 and still yet another was issued on Jan. 28, 1998 to Noftsier et al. as UK Patent No. 2 315 224.

U.S. Pat. No. 596,842

Inventor: Frank L. Borwell

Issued: Jan. 4, 1898

A waterproof material composed of an outer layer of duck, an inner layer of shoddy lining, and an interposed-layer of adhesive substance, such as gutta-percha, substantially as and for the purpose described.

U.S. Pat. No. 1,722,429

Inventor: Henry L. Kaufmann

Issued: Jul. 30, 1929

A protector for mattresses comprising a sheet of flexible protective material provided at either side with a hem along a marginal portion thereof, a plurality of rod sections arranged end to end in each of said hems, and flexible sleeve members fitting over end portions of adjoining rod sections and flexibly connecting the same together.

U.S. Pat. No. 2,585,861

Inventor: Jack Small et al.

Issued: Feb. 12, 1952

A protective cover for a mattress, comprising a pair of flexible sheet-like waterproof members each of a length substantially equal to that of the mattress and of a width less than the width of the mattress but greater than half the width of the mattress, and means for detachably connecting each of said members along one of its sides to a different one of the two sides of the mattress.

U.S. Pat. No. 3,066,321

Inventor: Mildred M. Kintner

Issued: Dec. 4, 1962

In combination: a mattress having a top panel, head and foot end panels and side panels, a strip of material having numerous small securing means thereon in closely spaced relation and secured on the margin of said top panel around the entire periphery of the mattress, a strip of material secured to the foot end panel spaced from the upper edge thereof and having numerous small securing means thereon in closely spaced relation, a strip of material secured to each side panel near the lower edge thereof and having numerous small securing means thereon in closely spaced relation, a strip of material secured to each side panel above said first mentioned strip of material and having numerous small securing means thereon in closely spaced relation, a sheet substantially the same size as the top panel of said mattress, a strip of material round the margin on the underside thereof and having numerous small securing means thereon in closely spaced relation for engaging and adhering to the strips on the top panel of said mattress, a sheet extending downwardly over the sides and foot end of said mattress, and strips of material along the foot and longitudinal edge on the inwardly facing side thereof and having numerous small securing means thereon in closely spaced relation for engaging and adhering to the strip on the two side panels near the lower edge thereof.

U.S. Pat. No. 3,113,326

Inventor: George C. Hyde

Issued: Dec. 10, 1963

A protective pad comprising a sheet of foamed elastomeric material encased in a vapor-tight envelope having extensions thereto at opposite ends thereof, of approximately one-half of the length of said envelope, said sheet of foamed elastomeric material being attached to said envelope at two corresponding edges thereof.

U.S. Pat. No. 3,989,867

Inventor: James Bryant Sisson

Issued: Nov. 2, 1976

Absorptive device having a breatheable backsheet resistant to aqueous liquid passage, wherein the backsheet has bosses and small apertures at the apex of the bosses, the apexes of the bosses being located adjacent the absorbent body with which the backsheet is associated.

U.S. Pat. No. 4,097,943

Inventor: Thomas Christopher O'Connell

Issued: Jul. 4, 1978

An absorbent pad which comprises a fluid-impervious backing sheet, a fluid-absorbent fabric adhering to one face of the backing sheet, and at least two strips of pressure-sensitive adhesive affixed on edge portions of the other face of the backing sheet for adhering the pad to a substrate, preferably in the form of a unitized underpad wherein the absorbent fabric layer is fully adhesively laminated to the impervious backing sheet. Preferably the adhesive strips are provided in the form of tape bearing pressure-sensitive on both sides thereof, one side of such tape being adhered to the exposed surface of the backing sheet, the adhesive strength on one side of the tape being greater than the adhesive strength on the other side of the tape.

U.S. Pat. No. 4,524,474

Inventor: Sven A. T. Svensson

Issued: Jun. 25, 1985

An absorption pad useful for protecting a bed, furniture, or the like, includes a lower liquid impervious material layer and an upper liquid absorbent material layer laminated thereto. The liquid absorbent layer is impregnated with strings or filaments of a liquid resistant agent which does not stiffen the pad. The strings or filaments form a grid-like pattern for defining compartments between the strings over preferably the entire area of the absorption pad, thereby for limiting the spread of liquid over the pad. The layers are laminated together, and may be laminated by an adhesive. The laminating areas may be in a filament pattern corresponding to and overlapping the filament pattern of the strings of the liquid resistant agent.

U.S. Pat. No. 5,249,320

Inventor: Herbert L. Moretz et al.

Issued: Oct. 5, 1993

A moisture-managing bed pad and bed sheet are provided for being positioned between a patient and a supporting surface. The bed sheet includes a moisture-managing bed pad. The bed pad includes a moisture transport top fabric layer for residing in patient contact and for wicking moisture away from the body of the patient. A moisture dispersal intermediate fabric layer resides adjacent the top fabric layer for receiving and dispersing moisture from the top fabric layer, and for providing a reservoir for moisture wicked inwardly from the top fabric layer. A liquid impermeable, vapor permeable bottom fabric layer resides adjacent to the intermediate fabric layer for providing a leak-proof barrier. The barrier permits dissipation of moisture in vapor form. The top, intermediate, and bottom fabric layers of the bed pad are attached by spot welds to form a unitary structure. One or more sheet sections reside adjacent to the bed pad for defining the bed sheet.

U.S. Pat. No. 5,388,296

Inventor: Joseph Mansour

Issued: Feb. 14, 1995

A novel bed accessory, such as a pillow, bed or crib sheet, is provided with a plurality of layers of foam rubber, elastomeric material or other resilient material capable of creating air ventilation to the surface of the accessory, as well as transmitting and storing body secretions for subsequent removal, the layers having varying degrees of softness with the outer layers being softer than the inner layers to maximize comfort to the user.

U.S. Pat. No. 5,701,617

Inventor: Gerard Joseph Colby

Issued: Dec. 30, 1997

An easily changeable, moisture resistant bedsheet formed of a bottom sheet component having water-permeable upper and lower textile sections, and a moisture-resistant center section; a moisture absorbent pad on the center section; and a textile cover sheet component of the same material as the upper and lower sections of the bottom sheet component releasibly secured over the pad and center section to give the appearance of a conventional single sheet formed of a single textile fabric.

U.S. Pat. No. 5,787,523

Inventor: Eva Lindberg

Issued: Aug. 4, 1998

The invention pertains to a low friction bed sheet or the like for facilitating changing the position of a person or part of a person in prone position. The low friction bed sheet includes at least a low friction surface comprising a material with low friction and adjacent to the low friction surface are high friction surfaces comprising materials with high friction. The low friction surface is placed only on the side against the person in bed while the underside against the bed is mainly comprised of at least one high friction surface. The width of the low friction surface is less than the width of the bedding for which the low friction bed sheet is intended. In the transition between the low friction surface and the high friction surface there are transition zones at least lengthwise in the bed which can be perceived by the person in the bed.

UK Patent Number 2 189 993

Inventor: Arthur Alfred Dilloway

Issued: Nov. 11, 1987

An absorbent sheet comprises a first sheet element of a material impermeable to liquids in at least one direction and a second sheet element having at least an area which is permeable to liquids in at least one direction, the two sheet elements lying one on top of the other and being attached together in such a way as to provide a pocket, at least in the permeable area, into which an absorbent material can be inserted, the first sheet element preventing liquids from passing out of the absorbent sheet and the second sheet element permitting the passage of liquids into the absorbent sheet in its permeable area.

UK Patent Number 2 315 224

Inventor: Ann Marie Noftsier et al.

Issued: Jan. 28, 1998

There is provided an absorbent article comprising a non-woven polyolefin porous top sheet and an absorbent core with a porous acquisition (or surge) layer disposed therebetween. The acquisition layer comprises a chemically bonded non-woven fabric of polyolefin fiber which is of larger pore size than the top sheet and is treated with a surfactant.

While these protective devices may be suitable for the purposes for which they were designed, they would not be as suitable for the purposes of the present invention, as hereinafter described.

SUMMARY OF THE PRESENT INVENTION

The present invention is a disposable or washable multi purpose protective device comprising a fitted construction sheet with elastic corners to provide a secure fit, which covers top and sides of an article to be protected, such as mattress or box spring as well as sofa and chair cushions. The protective device has a two-layer protection, constructed of a bottom impermeable leak resistant material layer for protection against soiling the article being protected with a soft fibrous absorbent top layer for comfort and absorption. The two layers are attached and may be manufactured of material that is antibacterial, anti-microbiodical and/or hypoallergenic. The instant invention provides for fitment to all size mattresses including baby mattresses as well as sofas, chair cushions and pillows. The instant invention also provides for a method of preparing a bed using the protective device where a package of multiple protective devices is provided as separate stacked entities or incorporated into the appearance of one whereby a single member is selectively peelable from the others. As separate stacked entities, the devices can be placed on the article to be protected either one on top of the other or have another user provided element placed between the protective devices. As an example, a mattress will have layers of linens applied starting first with the protective device then a sheet. The process repeats itself until there are a desired number of layers applied. All protective devices protect subsequent layers from being soiled, thereby decreasing the amount of labor needed to change linens, and decreasing stress on the person changing the linens and the person being cared for.

A primary object of the present invention is to provide a fitted protective element having an interior impervious layer and an exterior absorbent layer with an elastic element for tensioning the corners to an article to be covered.

Another object of the present invention is to provide a protective device having a protective element for covering and protecting a surface.

Another object of the present invention is to provide a fitted protective member having an interior surface formed from an impermeable material.

Yet another object of the present invention is to provide a fitted protective member having an exterior surface formed from an absorbent fibrous material.

Another object of the present invention is to provide a protective device wherein the protective element includes an interior impermeable layer and an exterior absorbent layer.

Yet another object of the present invention is to provide a protective device having securing element for tensioning the corners to an article to be covered.

Still yet another object of the present invention is to provide a protective device wherein the securing element is an elastic strap fastened along an edge at each corner thereof.

A further object of the present invention is to provide a fitted protective member having an elastic strap fastened to the edge of the corners and extending therebetween.

A yet further object of the present invention is to provide a protective device that is fitted.

A still yet further object of the present invention is to provide a protective device wherein the top layer absorbs fluids.

Another object of the present invention is to provide a protective device wherein the bottom layer prevents any unabsorbed fluid from contacting the article covered by the device.

A yet further object of the present invention is to provide a fitted protective member having spaced apart walls for encompassing the walls of an article being covered.

A still yet further object of the present invention is to provide a fitted protective member having a top layer for absorbing fluids and a bottom layer of an impermeable material to prevent seepage of fluid from the absorbent layer to the article being covered.

Yet another object of the present invention is to provide a protective device which is a disposable fitted sheet with an impermeable layer attached to a fibrous layer that will allow for absorption and an impermeable barrier to the layers below which if unsoiled may be reused on the same bed or seat cushion.

Still yet another object of the present invention is to provide a protective device that is simple to use and will reduce the amount of time spent changing linens in the hospital, other medical facilities or medical offices, home and skilled care living facility settings by allowing the bed to be layered with five complete sets of sheets (this number could vary depending upon the needs of the user) at one time with each separated and protected from above by this device. The device will allow the bed to be stripped of the top layer only leaving subsequent layers unsoiled and ready to use. (Each layer consists of a protective sheet along with a regular bed sheet).

A further object of the present invention is to provide a protective device that will reduce the number of persons needed to change linens in the hospital, home and skilled care facilities while reducing stress to the bed ridden person and the worker and or family member caring for the person.

A yet further object of the present invention is to provide a protective device for all types and sizes of mattresses, seat cushions and pillow covers used in hospital, home and skilled care facilities, which is economical in cost to manufacture.

Another object of the present invention is to provide a protective device that will overcome the shortcomings of the prior art devices.

Yet another object of the present invention is to provide a protective device that is washable and therefore reusable on an article to be protected.

A further object of the present invention is to provide a protective device that includes a plurality of protective elements removeably stacked vertically one on top of each other.

Yet another object of the present invention is to provide a protective device wherein each respective protective element is selectively removable from the protective device after a user has soiled the article.

A further object of the present invention is to provide a protective device wherein the protective element is positioned adjacent to a conventional bed sheet to form a sheet layer for protecting a mattress to which it is attached.

Still another object of the present invention is to provide a protective device including a plurality of sheet layers positioned adjacent to one another for easily removing soiled sheets and leaving a second clean protective device thereon.

A yet further object of the present invention is to provide a protective device for protecting at least one of mattresses, seat cushions and pillow covers.

Additional objects of the present invention will appear as the description proceeds.

The present invention overcomes the shortcomings of the prior art by a fitted protective device for bedding and furniture comprising an impermeable layer bonded to an absorbent fibrous layer. The layers are fastened together along the periphery thereof. An elastic strap is fastened at each corner of the device for retaining the device to a surface for protection thereof. When the device is fastened to the surface, the device protects the surface from any damages caused by fluids.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
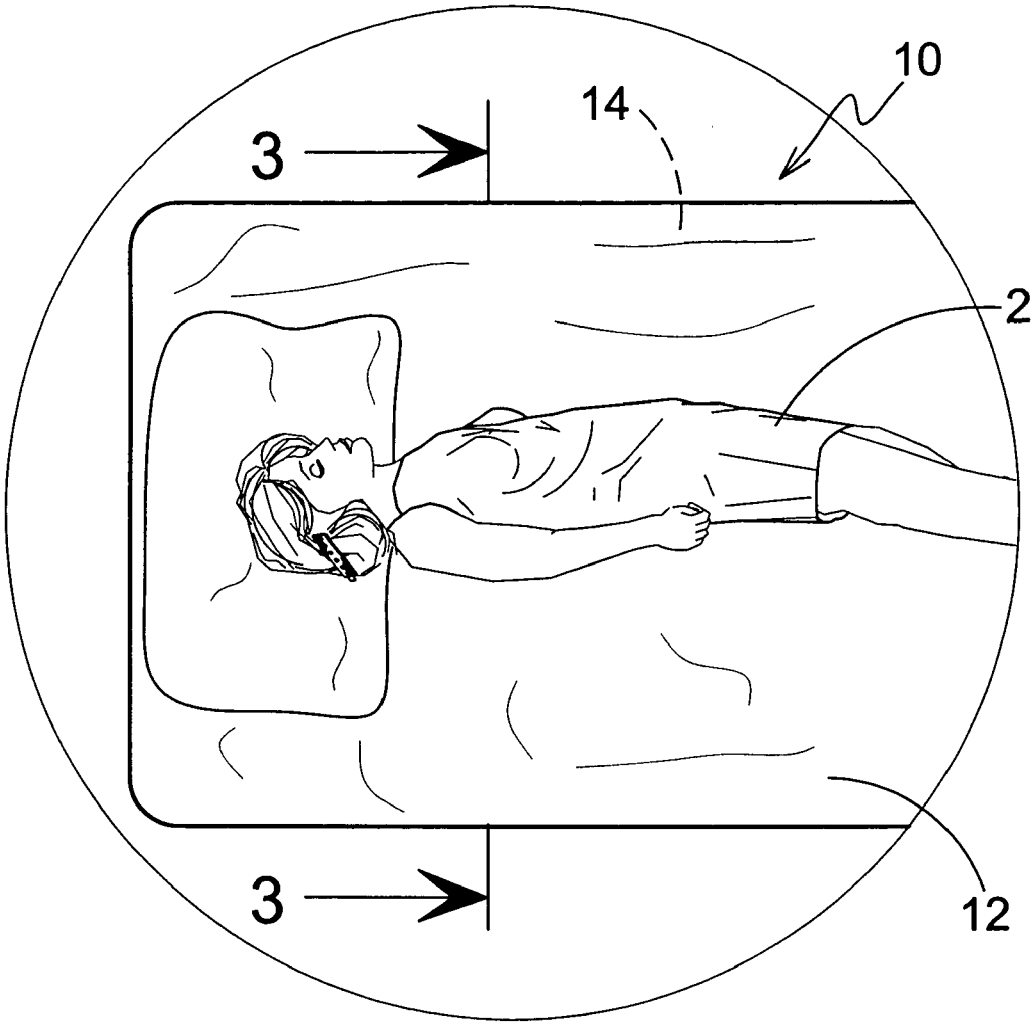
FIG. 1 is an illustrative view of the protective device of the present invention in use.

Turning now descriptively to the drawings, in which similar reference characters denote similar elements throughout the several views, the Figures illustrate the protective device of the present invention. With regard to the reference numerals used, the following numbering is used throughout the various drawing Figures.

2 user
3 sheet
5 impervious sheet
7 fluid
10 protective sheet of the present invention
11 top portion
12 side portion
13 bottom portion
14 article being protected
16 protective element
18 securing element
20 absorbent layer
22 impervious layer
24 soiled layer
26 clean layer
30 directional arrows
32 directional arrows

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 12 illustrate a protective device of the present invention indicated generally by the numeral 10.

Figure 11:
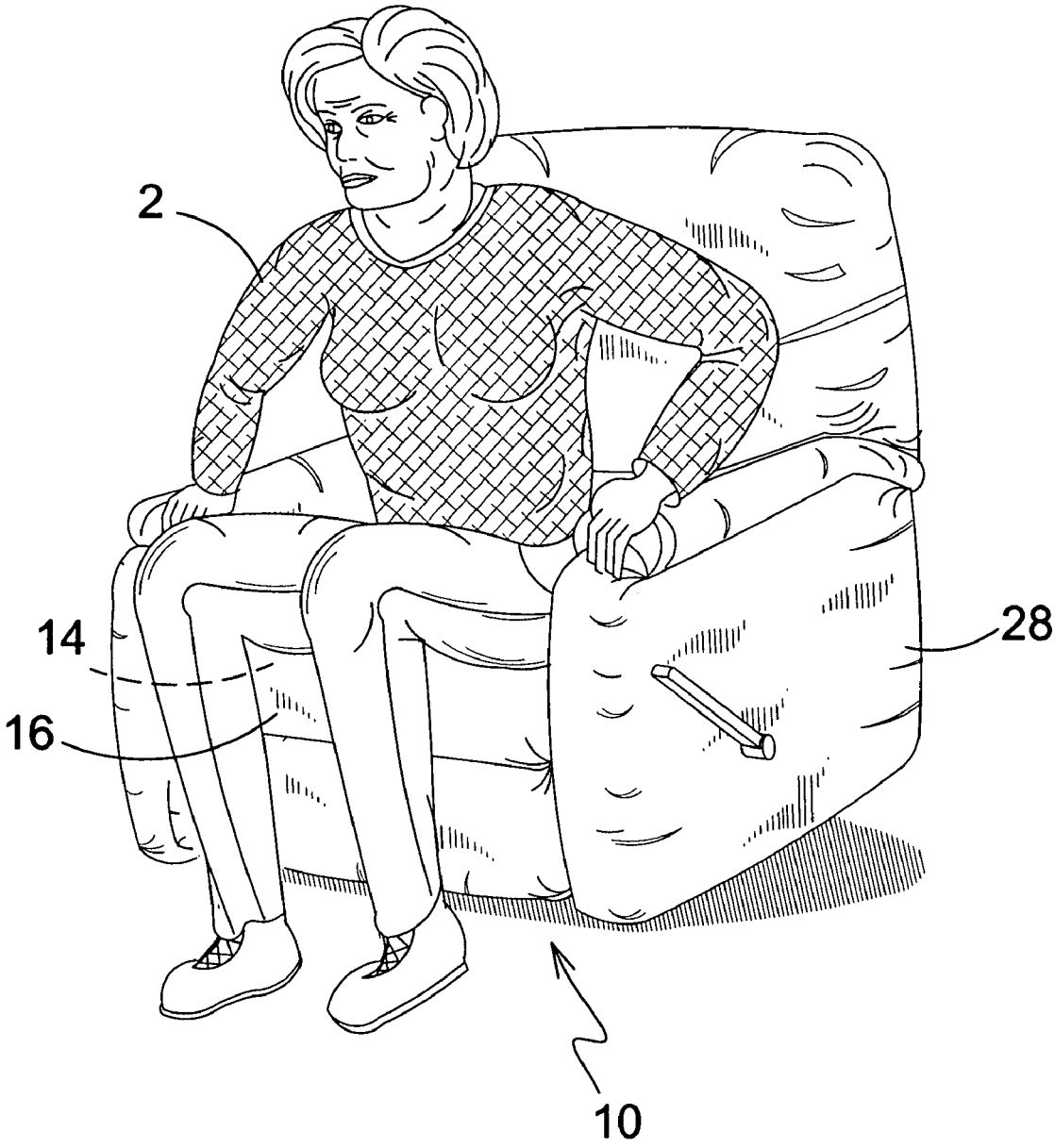
FIG. 11 is an illustrative view of an additional embodiment of the protective device of the present invention.
Figure 12:
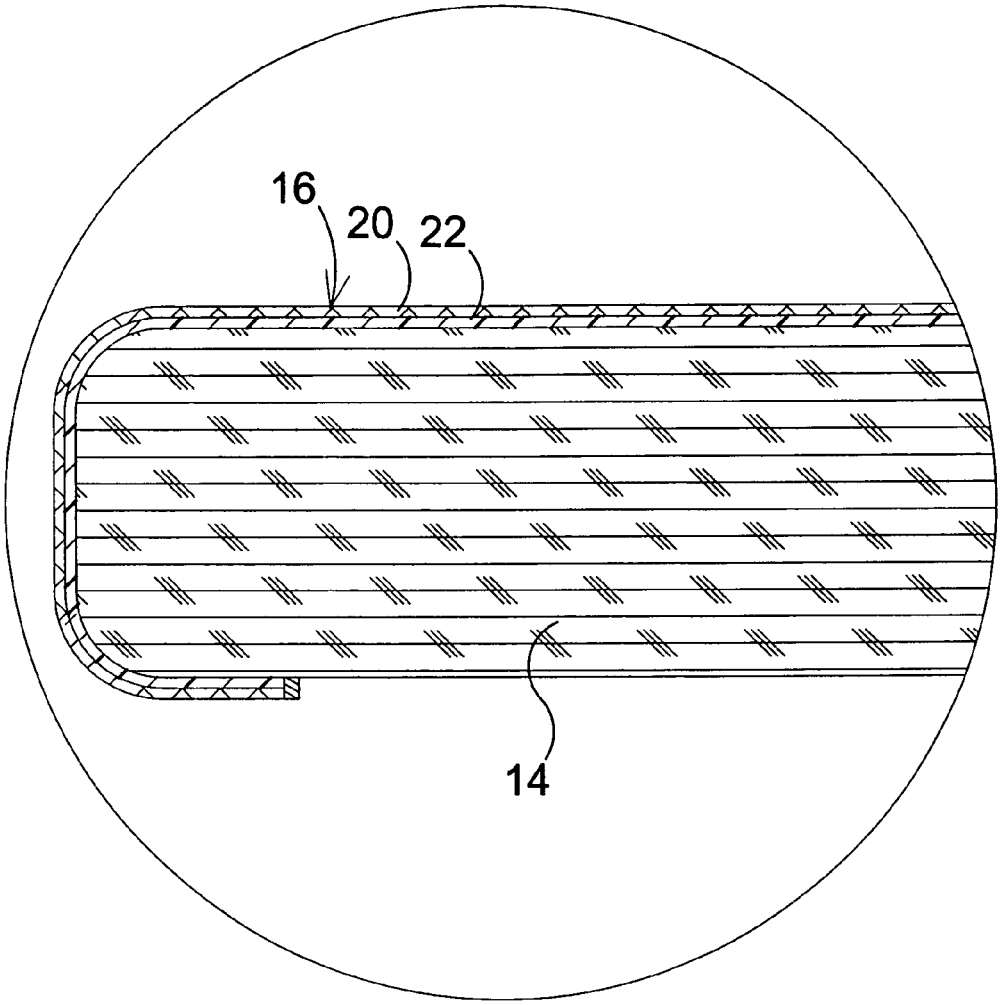
FIG. 12 is a cross-sectional view of the additional embodiment of the protective device of the present invention.

FIG. 1 is an illustrative view of the protective device of the present invention in use. The protective device 10 of the present invention is preferably a fitted protective member for seat cushions, mattresses and pillows for protection thereof having an elastic element peripherally fastened along the hem whereby the fitted member will encompass the top and sides and held thereto by the elastic element. As shown in FIG. 1, the protective device is fitted to cover a mattress 14. However, the protective device 10 can be used to protect any of the aforementioned articles. A user 2 is shown positioned on the protective device 10 covering the mattress 14. Preferably, the protective device 10 protects the top and sides of mattress 14 from any fluid or debris excreted by the user 2 who is positioned thereon. The manner in which the protective device 10 protects the mattress 14 will be discussed hereinafter with specific reference to FIGS. 3 B 8 and 10 B 12. The protective device is ideally used in hospital, nursing homes or home care settings whereby a caretaker is responsible for providing care to the user 2. Additionally, the protective device 10 may be used to protect the mattress 14 from bed wetting which may occur when a child is the user 2. Alternatively, as shown in FIGS. 11 and 12, the protective device 10 can be fitted in order to cover a cushion of a couch or chair for protection therefrom.

Figure 2:
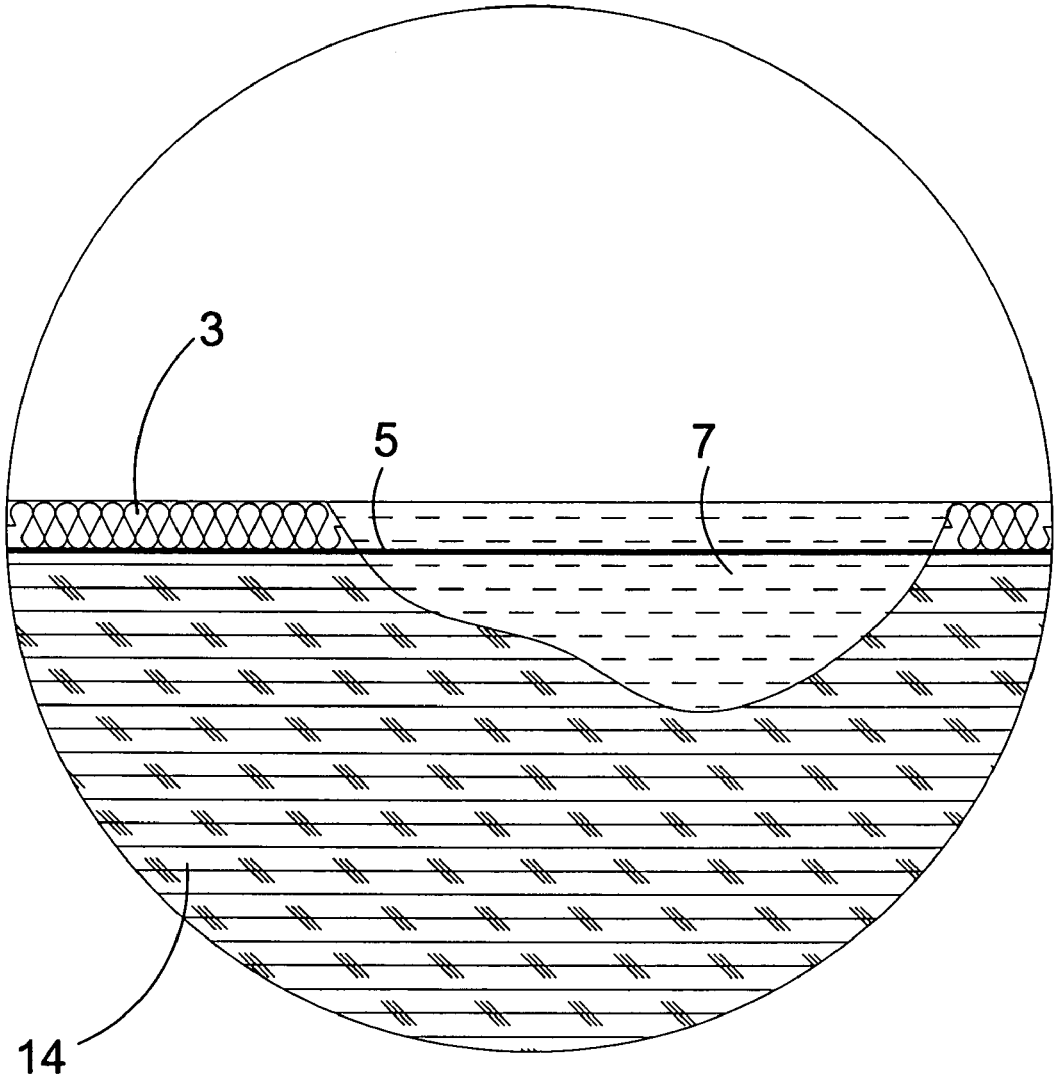
FIG. 2 (PRIOR ART)
FIG. 2 is a sectional view of a prior art protective device.

FIG. 2 is a sectional view of a prior art protective device. Shown herein is a typical prior art protective device formed from a protective sheet 5 positioned between a conventional sheet 3 and a mattress 14. The protective sheet 5 is formed from an impermeable material such as plastic and is designed to prevent fluid 7 from seeping through the sheet 3 to the mattress 14. The protective sheet 5 functions as a barrier and blocks the progress of the fluid 7. However, these devices are unsuccessful at completely preventing fluid 7 from damaging the mattress 14 because the protective sheet 5 is simply a planar sheet of rubber or other impermeable materials. The drawback associated with these prior art devices are that they have a tendency to become displaced by movement of the user and the fluids can simply run off the edge of the protective sheet 5 and contaminate the mattress 14. The protective device 10 as described in FIGS. 3 B 8 and 10 B 12 overcomes the shortcomings of these and other prior art protective devices by providing a fitted element that extends over the sides and encompasses the corners having an elastic element to prevent displacement of the device during use.

Figure 3:
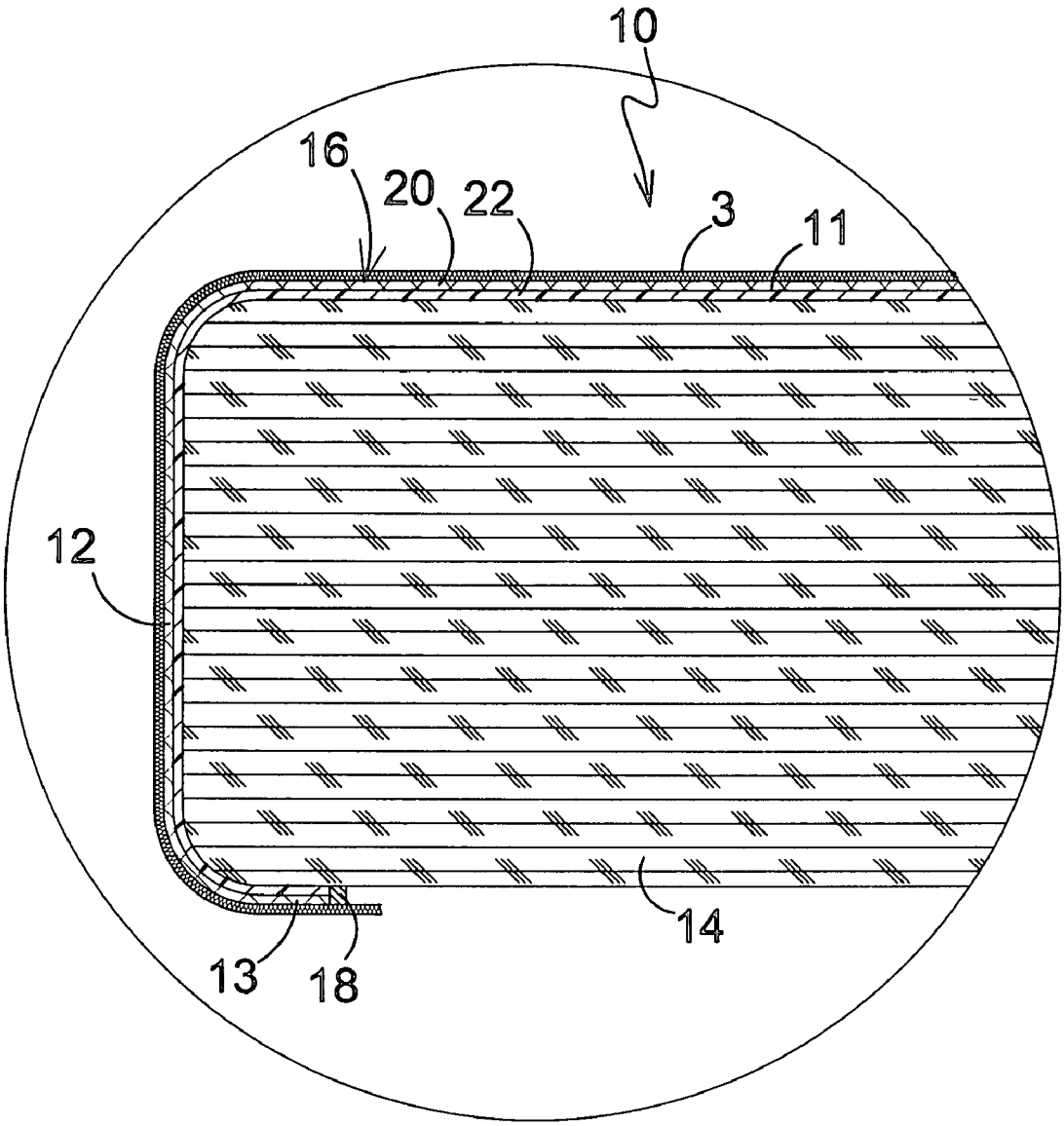
FIG. 3 is a cross sectional view of the protective device of the present invention taken along line 3 B 3 in FIG. 1.

FIG. 3 is a cross sectional view of the protective device of the present invention taken along line 3 B 3 in FIG. 1. The protective device 10 includes a protective element 16 and securing element 18, wherein protective element 16 is comprised of a top portion 11, side portion 12, and bottom portion 13. As illustrated, the protective element 16 is positioned between a top sheet 3 and mattress 14. While sheet 3 is shown covering the protective device 10, it would functionally be a matter of choice since the protective device 10 has an absorbent fibrous material 20, such as cotton, facing the user. The protective element 16 includes a first layer 20 and a second layer 22. The first layer 20 is secured to the second layer 22 forming a substantially unitary article. Preferably, the first layer 20 and the second layer 22 are bonded together by thermocoupling. However, any method of bonding may be used to secure the first layer 20 to the second layer 22. Upon positioning the protective device 10 on mattress 14, the first layer 20 of the protective element 16 contacts the top sheet 3 and the second layer 22 of the protective element 16 contacts the mattress 14. The protective device 10 is held in place on mattress 14 by securing member 18 fastened to the edge of bottom portion 13. Preferably the securing member 18 is an elastic material for securely holding the protective device to the mattress. It is also preferable that the securing member 18 for the protective device 10 used to cover couch 14 or seat cushions 14 as shown in FIGS. 11 and 12 are elastic as well in order to securely fit the protective device 10 to the article which is to be protected. The protective device 10 of the present invention may be formed in any size in order to provide top and side protection for any article.

Figure 4:
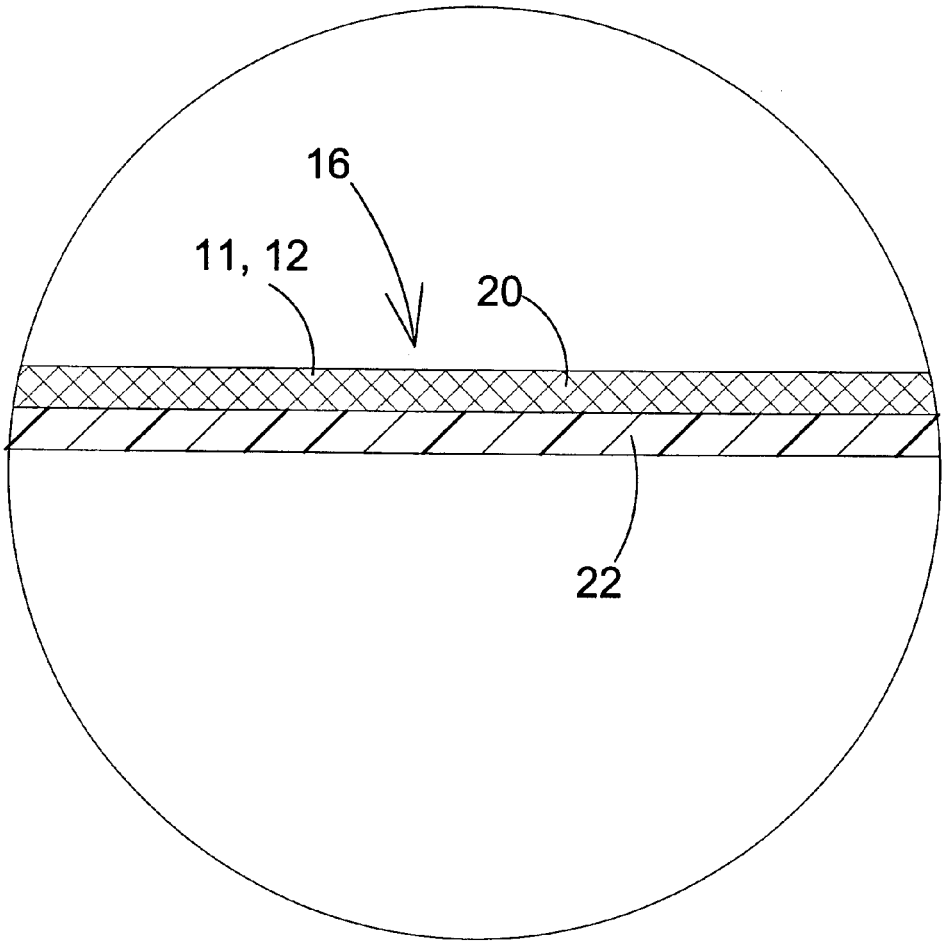
FIG. 4 is a partial sectional view of the protective device of the present invention.

FIG. 4 is a partial sectional view of the protective device of the present invention. The protective device 10 includes protective element 16. As shown in FIG. 3, the protective element 16 is selectively positioned between top sheet 3 and the mattress 14. The protective element 16 includes the first layer 20, which is preferably absorbent and the second layer 22, which is preferably fluid impermeable. The absorbent layer 20 is secured to the second layer 22 forming a substantially unitary article. Preferably, the absorbent layer 20 and the fluid impermeable layer 22 are bonded together by thermocoupling. However, any method of bonding may be used to secure the first layer 20 to the second layer 22. The protective device 10 is held in place on the article selected for protection by securing member 18 fastened at least to the bottom corners of 13. Preferably the securing member 18 is an elastic material for securely holding the protective device 10 to the article selected for protection, whether that article 14 is bedding material such as, a mattress or pillow or furniture cushions. It is also preferable that the securing member 18 for the protective device 10 used to cover couch or seat cushions as shown in FIGS. 11 and 12 is elastic as well in order to securely fit the protective device 10 to the article 14 being protected. The protective device 10 of the present invention may be formed in any size in order to provide protection for any article or piece of furniture. The protective element 16 can also be manufactured from material whereby said protective element 16 is hypoallergenic, antibacterial and/or anti-microbiodical.

The absorbent layer 20 is an absorbent layer for absorbing bodily fluid that is excreted from a user who is positioned on the protective device 10. The absorbent layer 20 is formed from an absorbent fibrous material, such as cotton or cotton poly blend surface with an absorbent layer of poly rayon or poly encompassing top portion 11, side portion 12, and bottom portion 13. The absorbent layer 20 being formed from cotton is described for purposes of example only and any fibrous material that can absorb fluid may be used to form the absorbent layer 20. The second layer 22 is a fluid impermeable material having a top portion 11, side portion 12 and bottom portion 13. The second layer 22 may be formed from at least one of elastomeric material, such as rubber, waterproof vinyl, or polymeric material such as plastic. Preferably, the second layer 22 is formed from polymeric plastic material. The second layer 22 being formed from elastomeric or polymeric material is described for purposes of example only, any material that is impermeable to fluids or debris may be used to form the second layer 22.

Figure 5:
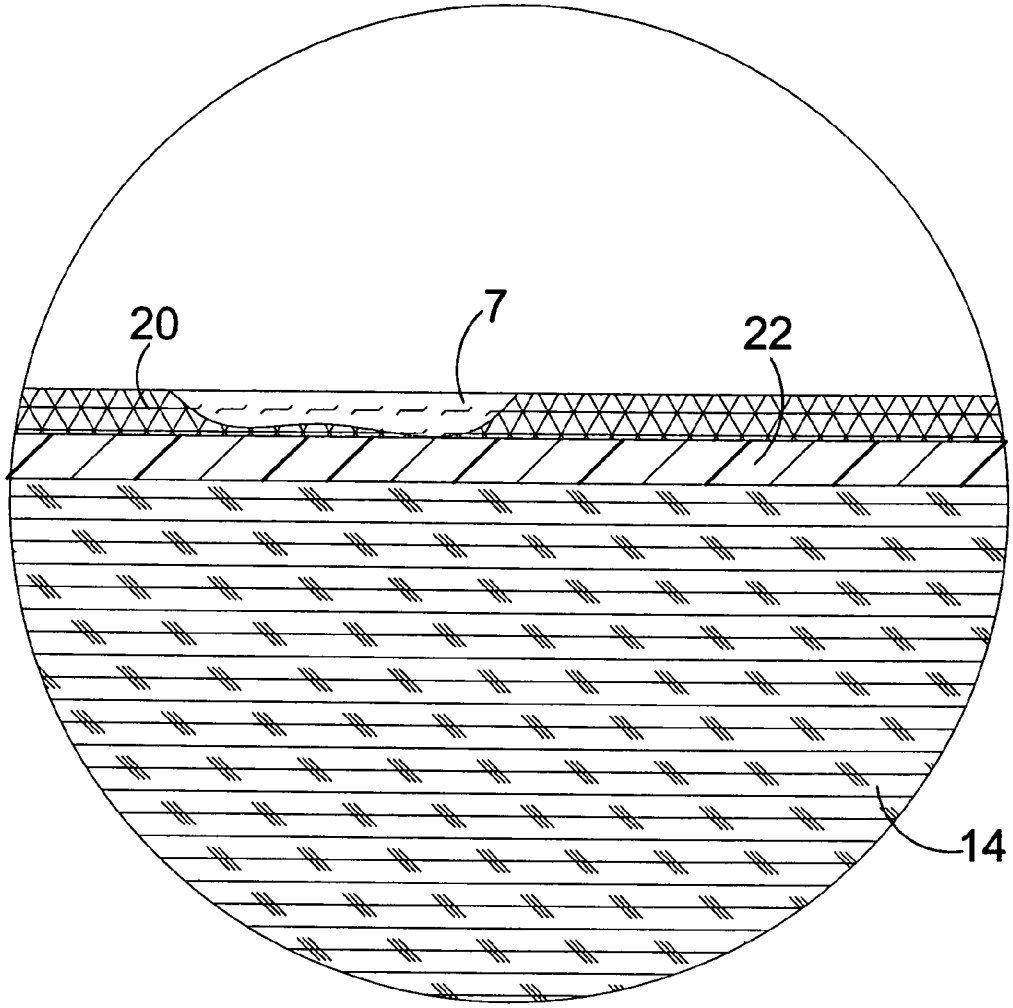
FIG. 5 is an illustrative view of an article being protected by the protective device of the present invention in use.

FIG. 5 is an illustrative view of an article being protected by the protective device of the present invention. Illustrated is the protective device 10 providing protection to a mattress 14 selected for protection. Fluid 7 is shown soiling the protective element 16. The fluid 7 is absorbed by the absorbent layer 20. Thereafter, should the absorbent layer 20 be saturated with fluid 7, the second impermeable layer 22 prevents fluid 7 from permeating into and damaging the mattress 14. As shown in FIG. 3, the protective element 16 has top portion 11, side portion 12 and bottom portion 13 encompassing the article being protected, thereby preventing fluid 7 from wicking around the top edges as previously stated for the prior art devices. The securing members 18, as shown in FIG. 3, provides further protection by preventing unwanted movement during use of the protective device 10 of the present invention. Upon being soiled, as shown in FIG. 5, the protective device can be removed and replaced with a new un-soiled protective device thereby keeping the article selected for protection 14 clean. The protective device 10 includes the protective element 16. As previously stated, the protective element 16 can be selectively positioned between top sheet 3 and the mattress 14. The protective element 16 includes first absorbent layer 20 and second impermeable layer 22. The absorbent layer 20 is secured to the impermeable layer 22 forming a substantially unitary article having top portion 11, side portion 12 and bottom portion 13. Preferably, first layer 20 and second layer 22 are bonded together by thermocoupling. However, any method of bonding may be used to secure the first layer 20 to the second layer 22 with the protective device 10 held in place on the selected article being protected by the securing member 18 fastened to bottom portion 13. Preferably the securing member 18 is an elastic material for securely holding the protective device 10 to the article being protected 14. It is also preferable that the securing member 18 for the protective device 10 used to cover couch 14 or seat cushions 14 as shown in FIGS. 11 and 12 is elastic as well in order to securely fit the protective device 10 to the article 14 being protected. The protective device 10 of the present invention may be formed in any size in order to provide protection for any article or piece of furniture and manufactured with properties wherein the protective device 10 is hypoallergenic, antibacterial and/or anti-microbiodical.

Figure 6:
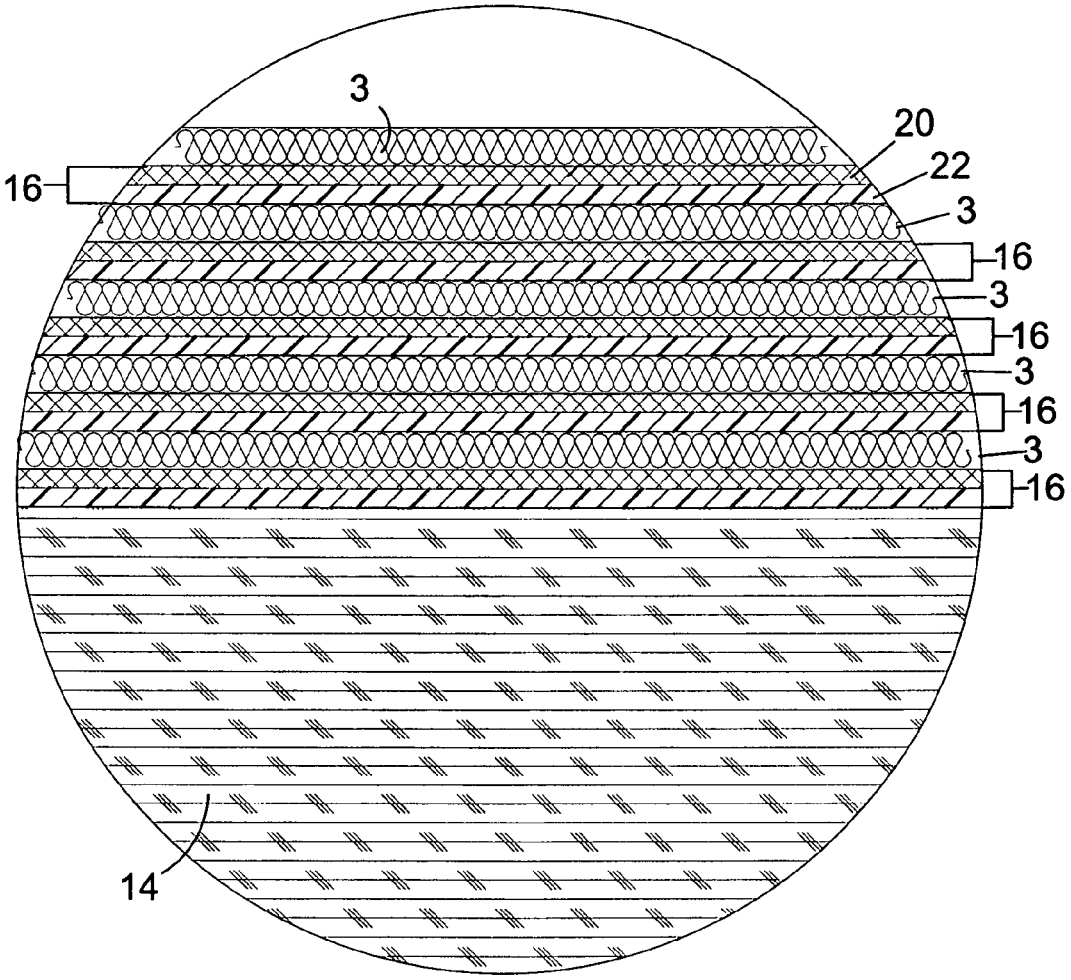
FIG. 6 is a cross-sectional view of a plurality of vertically stacked bed sheets between a plurality of protective devices of the present invention.

FIG. 6 is a sectional view of a plurality of vertically stacked bed sheets between a plurality of protective devices of the present invention. The protective device 10 includes the protective element 16 and securing element 18. As illustrated, one method of using the present invention is to interleaf a plurality of protective devices 10 with a plurality of sheets 3 encompassing mattress 14. In caring for bed ridden patients it is necessary to change the linens. It would be easier on the caretaker and the patient if multiple layers of the protective device 10 were in place whereby, the patient rolls or is rolled onto their side while a single protective device 10 is detached from part of the bed and moved up against the patient whereupon the patient would roll or be rolled onto the clean sheet 3 while the remainder of the selected protective device 10 is removed, which would be less of an intrusion on the patient. Therefore, the present invention incorporates a method of use in addition to the fitted protective device 10. The protective element 16 includes the absorbent layer 20 and the impermeable layer 22 having top portion 11, side portion 12, and bottom portion 13, thereby preventing the soiling of one layer from permeating to another layer. Upon positioning the protective device 10 and sheet 3 on a mattress 14, the absorbent layer 20 of the protective element 16 contacts top sheet 3 and fluid impermeable layer 22 of the protective element 16 contacts mattress 14. Subsequent interleaf placement of protective device 10 and sheet 3 continues until the desired number of layers is achieved. Upon a user soiling the top sheet 3, the protective element 16 adjacent to the top sheet absorbs the fluid leaving the subsequent layers unsoiled. This use of the protective device results in caretakers having an easier time in changing bed linens, especially for bedridden patients. The patient is rolled onto their side while the top most protective device 10 is detached from the plurality of stacked protective devices 10 and sheets 3 and moved up against the patient whereupon the patient would roll or be rolled onto the clean sheet 3 while the remainder of the soiled protective device 10 and sheet 3 is removed.

Figure 7:
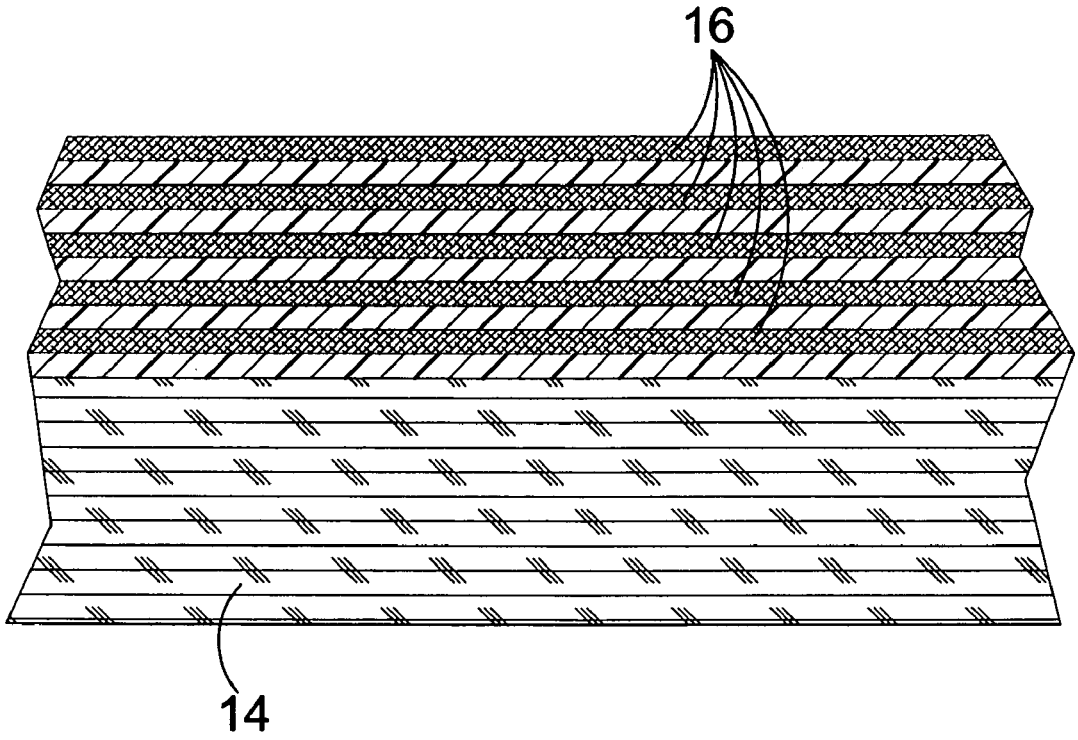
FIG. 7 is cross-sectional view of a plurality of vertically stacked devices of the present invention.

FIG. 7 is cross-sectional view of a plurality of vertically stacked protective devices of the present invention. The protective device 10 includes the protective element 16 and securing element 18 with the protective element 16 having a first absorbent layer 20 and a second impermeable layer 22 bonded to form a unitary article having a top portion 11, side portion 12, and bottom portion 13 with securing element 18 fastened to the edge of bottom portion 13. An additional element of the present invention is illustrated wherein a plurality of protective devices 10 are packaged that may or may not be attached to one another, but will otherwise be packaged as folded and stacked protective devices 10 or stacked inside one another. For instance: possibly five protective devices 10 stacked inside each other making up one application (looks like one protective device 10, actually has five) to surface i.e. bed, cushion, pillow etc that will make for a quick and easy application. When attached either sewn or bonded, singular protective devices 10 having a burstable means of attachment can be selectively removed or peeled one layer 10 at a time as needed. The function of the prepackaged multilayered protective devices is consistent with the present invention wherein caring for bed-ridden patients it is necessary to change the linens, it would be easier on the caretaker and the patient if multiple layers of the protective member were in place. Thereby with the patient rolling or being rolled onto their side while a single protective device 10 was detached from part of the bed and moved up against the patient whereupon the patient would roll onto the clean protective device 10 while the remainder of the soiled protective device 10 was removed would be less of an intrusion on the patient. Therefore, the present invention incorporates a multilayered protective device 10 within the method of use in addition to the singular fitted protective device 10.

Figure 8:
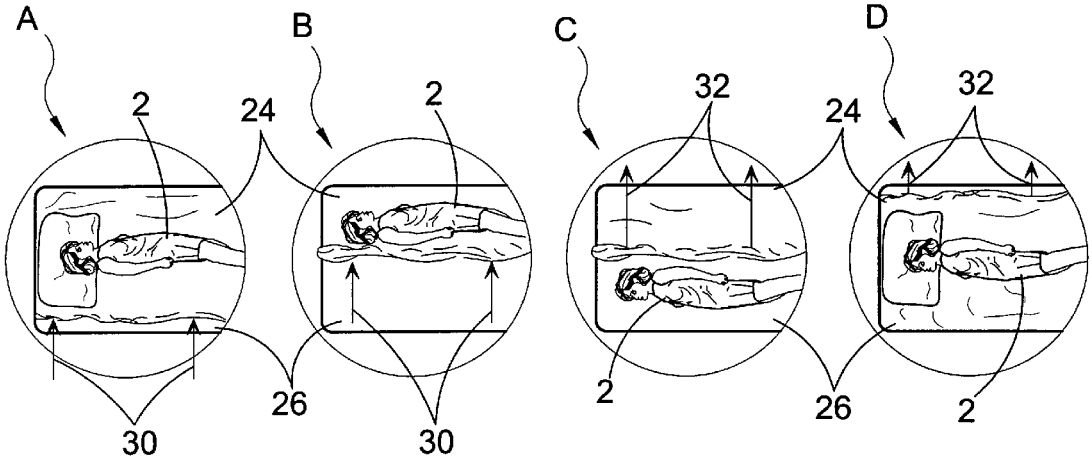
FIG. 8 is an illustrative view of a bed having a protective device of the present invention positioned thereon being changed.

FIG. 8 is an illustrative view of a bed having a protective device of the present invention positioned thereon being changed. Illustrated is the method of changing bed linen having a plurality of the fitted protective members installed on a mattress. As illustrated the process involves having a patient on the bed and removing the top fitted protective device 10 from the bed by slipping the corners off of one side of the mattress, as depicted in the circle labeled "A", a user 2 positioned on a soiled layer 24 of the protective device 10 of the present invention which is being removed from the mattress in a direction signified by directional arrows 30. The patient rolls onto their side while the top member is drawn together and positioned in close proximity to the patient. In the circle labeled "B", the user 2 is shown positioned on an end of the mattress 14 with the soiled layer 24 being removed to a midpoint of the mattress. The patient then rolls onto their other side with the next clean fitted protective device 10 now forming the top layer, as depicted in the circle labeled "C", the user 2, is rolled onto a clean layer 26 and the soiled layer 24 is moved in a direction indicated by directional arrow 32. The fitted member 10 selected for removal has the remaining corners slipped off of the mattress whereby the protective device 10 is now free to be completely removed from the bed. The circle labeled "D" shows the user lying comfortably on the clean layer 26 and the soiled layer 24 completely removed from the mattress 14. While a sheet 3 can be used to cover the protective device 10, it would functionally be a matter of choice since the protective device 10 includes absorbent layer 20 formed from an absorbent fibrous material, such as cotton, which contacts the skin of the user.

Figure 9:
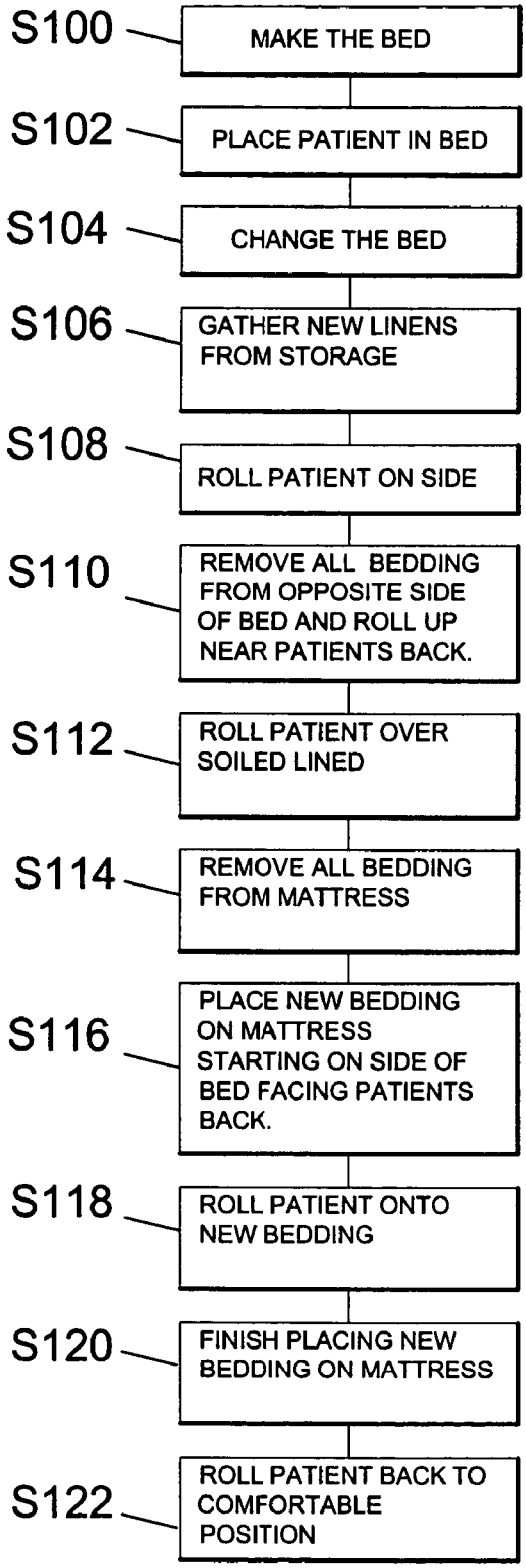
FIG. 9 is a flow chart detailing the prior art method for changing bed linen.

FIG. 9 is a flow chart detailing the prior art method for changing bed linen. As shown in step S100, the bed is made using bed linen. Thereafter, the patient is placed in bed as shown in step S102. The bed is then changed as in step S104 which requires obtaining bed linen from storage as shown in step S106. The patient is rolled onto their side as in step S108 and all of the bedding from the edge opposite the patient must be rolled up near the patients back as in step S110. Thereafter, the patient is rolled over the soiled linen as in step S112 and all of the bedding is then removed from the mattress as shown step S114. Thereafter, new bedding is placed on the mattress starting on the edge opposite the patient as in step S116. The patient is then rolled onto the new bedding as in step S118 and the bedding completely secured to the bed as in step S120. Upon the bedding being completely secured to the mattress, the patient can be returned to a comfortable position in the bed as shown in step S122.

Figure 10:
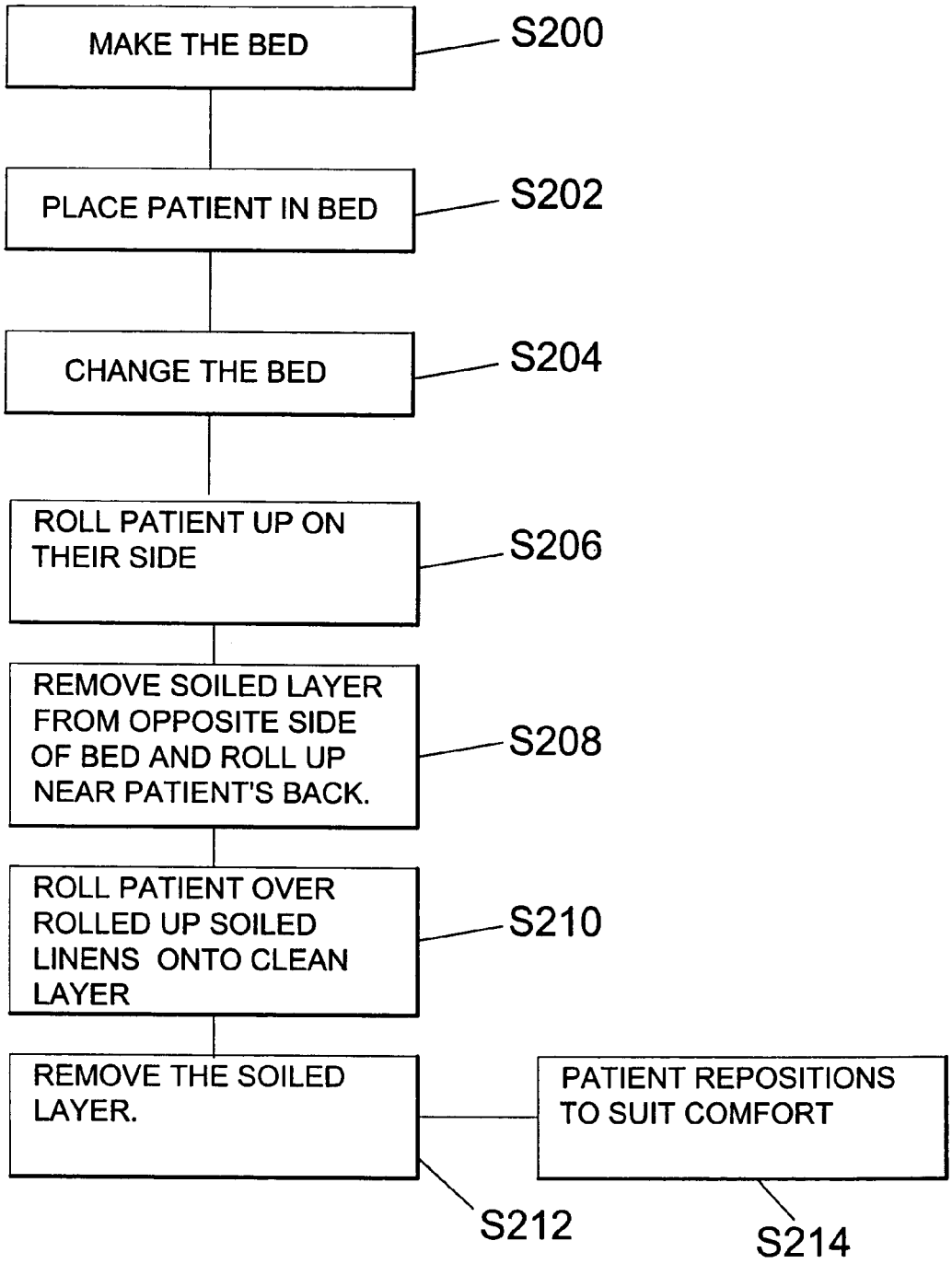
FIG. 10 is a flow chart detailing the method of changing bed linen using the protective device of the present invention.

FIG. 10 is a flow chart detailing the method of changing bed linen using the protective device of the present invention. Absorbent, a bed is made using the protective device 10 of the present invention as shown in step S200. Thereafter, a patient is placed in bed as in step S202. Upon the patient soiling the bed, the bed needs to be changed as in step S204. The patient is then rolled onto their side as in step S206 and the soiled layer is removed beginning at the edge of the bed opposite the patient as in step S208. The patient is then rolled over soiled linen onto clean layer of protective element 16 as in step S210. The soiled layer is then completely removed as in step S212 and the patient is returned to a comfortable position S214.

FIG. 11 is an illustrative view of an additional embodiment of the protective device of the present invention. Shown is the protective device 10 being used to protect a cushion 14 on a recliner. The protective device 10 includes the protective element 16. The protective element 16 is positioned over a chair cushion 14. The protective element 16 includes the first absorbent layer 20 and the second impermeable layer 22. The absorbent layer 20 is secured to the fluid impermeable layer 22 forming a substantially unitary article. Preferably, the absorbent layer 20 and the impermeable layer 22 are bonded together by thermocoupling. However, any method of bonding may be used to secure the first layer 20 to the second layer 22. Upon positioning the protective device 10 on the cushion, the absorbent layer 20 of the protective element 16 contacts the user 2 and the second layer 22 of the protective element 16 contacts the cushion 14. The protective device 10 is held in place on the cushion 14 by the securing member 18. Preferably the securing member 18 is an elastic material for holding securing the protective device 10 to the cushion. The securing member 18 is positioned around the periphery of the protective element 16. The protective device 10 of the present invention may be formed in any size in order to provide protection for any article or piece of furniture and manufactured with properties wherein the protective device 10 is hypoallergenic, antibacterial and/or anti-microbiodical.

FIG. 12 is a sectional view of the additional embodiment of the protective device of the present invention. The protective device 10 includes the protective element 16 covering the top and sides of cushion 14 and securing element 18. The protective element 16 includes absorbent layer 20 and impermeable layer 22. The absorbent layer 20 is secured to the second layer 22 forming a substantially unitary article. Upon positioning the protective device 10 on cushion 14, the absorbent layer 20 of the protective device 10 contacts the user with the impermeable layer 22 contacting cushion 14. The protective device 10 is held in place on cushion 14 by an elastic material attached to the periphery of protective element 16. The present invention is a disposable or washable multi purpose protective device 10 comprising a fitted construction sheet 20, 22 which covers top and sides of an article to be protected, such as mattress or box spring as well as sofa and chair cushions having elastic corners 18 to provide a tensioned fit. The protective device 10 has a two-layer protection, constructed of a bottom impermeable leak resistant material layer 22 for protection against soiling the article being protected with a soft fibrous absorbent top layer 20 for comfort and absorption. The two layers are attached and may be manufactured of material that is antibacterial, anti-microbiodical and/or hypoallergenic.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A protective device for providing protection against wetting to a mattress or a cushion comprising:

a) a fitted protective sheet having a first absorbent layer and a second impervious layer connected to said first layer, said second layer being in contact with a surface of said mattress or cushion;

b) said protective sheet wrapping around sides to and terminating in an underside of said mattress or cushion, and an elastic securing member attached to an outer edge and extending along a perimeter of said protective sheet running along said underside of said mattress or cushion to prevent seepage of liquid into said mattress or cushion; and c) a fitted bed sheet covering completely said protective sheet on said mattress or cushion.

2. The device as recited in claim 1, where said first layer is formed from a fibrous material for absorbing a fluid therein.

3. The device as recited in claim 2, wherein said fibrous material is taken from the list of cotton, cotton polyester blend, polyester rayon and polyester.

4. The device as recited in claim 3, wherein said second layer is an impermeable layer for preventing a fluid from passing therethrough.

5. The device as recited in claim 4, wherein said impermeable layer is formed from at least one of polymeric material and elastomeric material.

6. The device as recited in claim 5, wherein said polymeric material is plastic.

7. The device as recited in claim 5, wherein said elastomeric material is rubber.

8. The device as recited in claim 1, wherein said protective sheet is disposable.

9. The device as recited in claim 1, wherein said protective sheet is washable.

10. The device as recited in claim 1, wherein said protective sheet is from at least one of antibacterial, antimicrobiodical and hypoallergenic.

11. A protective device for providing protection against wetting of a mattress or a cushion comprising:

a) a plurality of stacked fitted protective sheets each having a first absorbent layer and a second impervious layer connected to said first layer, said second layer of a protective at a bottom of said stack being in contact with a surface of said mattress or cushion;

b) said protective sheets wrapping around sides of and terminating in an underside of said mattress or cushion, and an elastic securing member attached to an outer edge and extending over a perimeter of each said protective sheet running along said underside of said mattress or cushion;

c) a fitted bed sheet covering completely said stack of protective sheets on said mattress or cushion;

d) a fitted bed sheet between each of the protective sheets in said stack; and e) each bed sheet being unattached to any protective sheet or to any other bed sheet and each protective sheet being unattached to any other protective sheet, so that an upper bed sheet with a protective sheet upon removal exposes a fresh bed sheet with another protective sheet under said fresh bed sheet.

12. A method of providing protection against wetting of a mattress or a cushion comprising the steps of:

a) placing a plurality of stacked fitted protective sheets with a fresh fitted bed sheet between adjacent protective sheets over a mattress or cushion, each protective sheet having a first absorbent layer and a second impervious layer connected to said first layer, said second layer of a protective sheet at a bottom of said stack being in contact with a surface of said mattress or cushion;

b) wrapping said protective sheets around sides of and terminating in an underside of said mattress or cushion, with an elastic securing member attached to an outer edge and along a perimeter of each said protective sheet running along said underside of said mattress or cushion;

c) covering completely said stack of protective sheets with a fitted outer bed sheet, each bed sheet being unattached to any protective sheet or to any other bed sheet and each protective sheet being unattached to any other protective sheet;

d) upon soiling of ad outer bed sheet, removing said outer bed sheet and an underlying protective sheet revealing a fresh bed sheet with a fresh protective sheet underneath; and e) repeating the step of removing an outer bed sheet along with an underlying protective sheet until the stack of protective sheets and bed sheets is gone.

* * * * *